US009434066B1

(12) United States Patent
Hedgecock

(10) Patent No.: US 9,434,066 B1
(45) Date of Patent: Sep. 6, 2016

(54) FLAG-MANEUVERING TOOL

(71) Applicant: Donald Hedgecock, Phoenix, AZ (US)

(72) Inventor: Donald Hedgecock, Phoenix, AZ (US)

( * ) Notice: Subject to any disclaimer, the term of this patent is extended or adjusted under 35 U.S.C. 154(b) by 0 days.

(21) Appl. No.: 15/006,550

(22) Filed: Jan. 26, 2016

(51) Int. Cl.
*B25J 1/04* (2006.01)

(52) U.S. Cl.
CPC ..... *B25J 1/04* (2013.01)

(58) Field of Classification Search
CPC ..... B25J 1/04; A47F 13/06
USPC ..... 294/92, 174, 209–211; 81/53.1, 53.11
See application file for complete search history.

(56) References Cited

U.S. PATENT DOCUMENTS

| | | | | | |
|---|---|---|---|---|---|
| 909,729 | A * | 1/1909 | Wollam | B25J 1/04 | 294/24 |
| 1,467,799 | A * | 9/1923 | Larsen | B25J 1/04 | 294/22 |
| 2,716,570 | A * | 8/1955 | Beeman | B25J 1/04 | 294/22 |
| 3,342,519 | A | 9/1967 | Hunt | | |
| 3,032,362 | A | 4/1982 | Assmann | | |
| 5,065,537 | A * | 11/1991 | Bailey | G09F 7/12 | 294/211 |
| 5,379,666 | A * | 1/1995 | Held | H01J 9/006 | 294/211 |
| 5,730,033 | A * | 3/1998 | Mitrowski | H01J 9/006 | 294/104 |
| 5,769,474 | A | 6/1998 | Moore | | |
| 5,806,903 | A * | 9/1998 | George | B25J 1/04 | 116/173 |
| 5,941,587 | A | 8/1999 | Wolff | | |
| 6,473,929 | B1 * | 11/2002 | Learned, III | A46B 5/02 | 15/143.1 |
| D478,649 | S | 8/2003 | Steudeman | | |
| 2,493,108 | A1 | 1/2004 | Nang | | |
| 2013/0333197 | A1 | 12/2013 | Schulte | | |
| 2014/0001785 | A1 * | 1/2014 | Lavarias | A01K 97/00 | 294/211 |

FOREIGN PATENT DOCUMENTS

| | | |
|---|---|---|
| CA | 717876 A | 9/1965 |

* cited by examiner

*Primary Examiner* — Dean Kramer
(74) *Attorney, Agent, or Firm* — Kyle A. Fletcher, Esq.

(57) ABSTRACT

The flag-maneuvering tool is a device that is used to aid in installation or removal of a flagpole with respect to a flagpole bracket. The flag-maneuvering tool is ideally installed onto a first pole, and which is then manually maneuvered to engage the flagpole for insertion into or removal of the flagpole with respect to the flagpole bracket. The flag-maneuvering tool is further defined with a handle tube that is able to receive a first pole. The handle tube is acutely oriented with respect to a flagpole member. The flagpole member is ideally constructed of a piece of angle iron. A first distal end of the flagpole member includes a holding sleeve thereon, and which works in concert with the flagpole member to adaptively secure onto a flagpole. The flagpole member being a piece of angle iron is open from above, and rigidly affixed to the handle tube.

10 Claims, 4 Drawing Sheets

FLAG-MANEUVERING TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of hand-held tools, more specifically, a tool that is affixed to a pole and used to aid in maneuvering a flagpole.

SUMMARY OF INVENTION

The flag-maneuvering tool is a device that is used to aid in installation or removal of a flagpole with respect to a flagpole bracket. The flag-maneuvering tool is ideally installed onto a first pole, and which is then manually maneuvered to engage the flagpole for insertion into or removal of the flagpole with respect to the flagpole bracket. The flag-maneuvering tool is further defined with a handle tube that is able to receive a first pole. The handle tube is acutely oriented with respect to a flagpole member. The flagpole member is ideally constructed of a piece of angle iron. A first distal end of the flagpole member includes a holding sleeve thereon, and which works in concert with the flagpole member to adaptively secure onto a flagpole. The flagpole member being a piece of angle iron is open from above, and rigidly affixed to the handle tube.

These together with additional objects, features and advantages of the flag-maneuvering tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the flag-maneuvering tool in detail, it is to be understood that the flag-maneuvering tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the flag-maneuvering tool.

It is therefore important that the claims be regarded as including such equivalent construction insofar as they do not depart from the spirit and scope of the flag-maneuvering tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
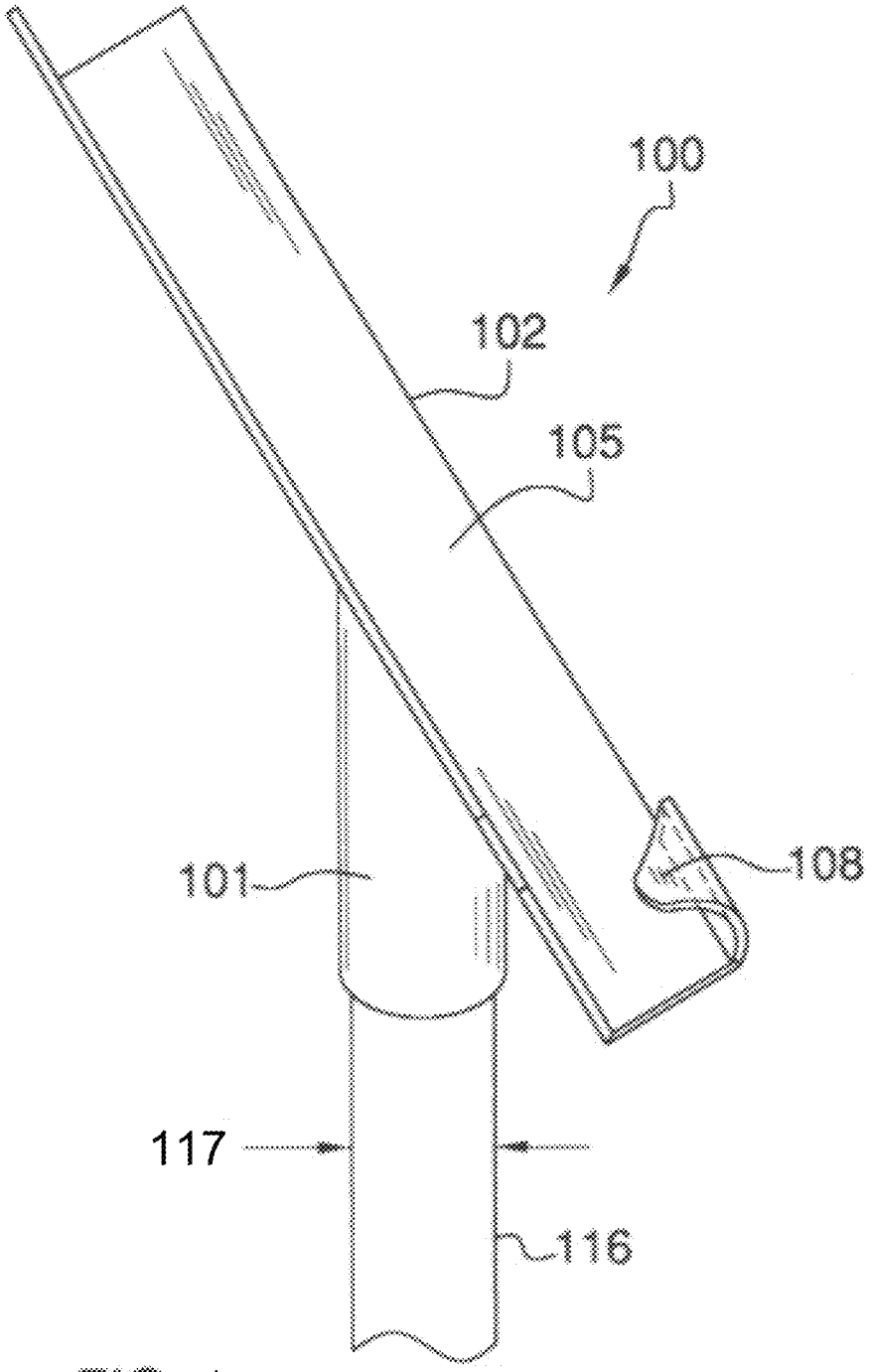
FIG. 1 is a perspective view of an embodiment of the disclosure.
Figure 2:
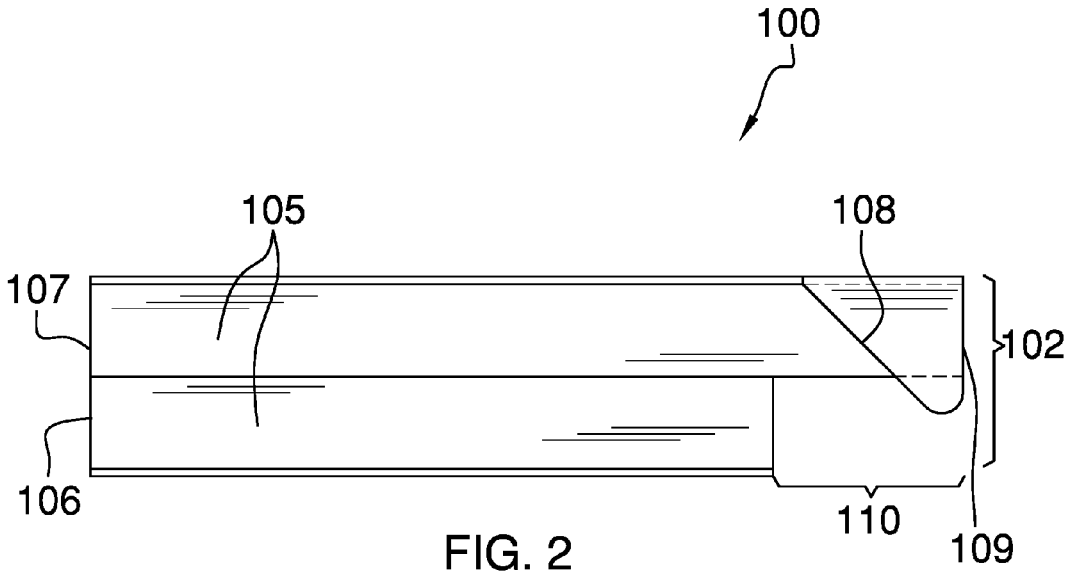
FIG. 2 is a top view of an embodiment of the disclosure.
Figure 3:
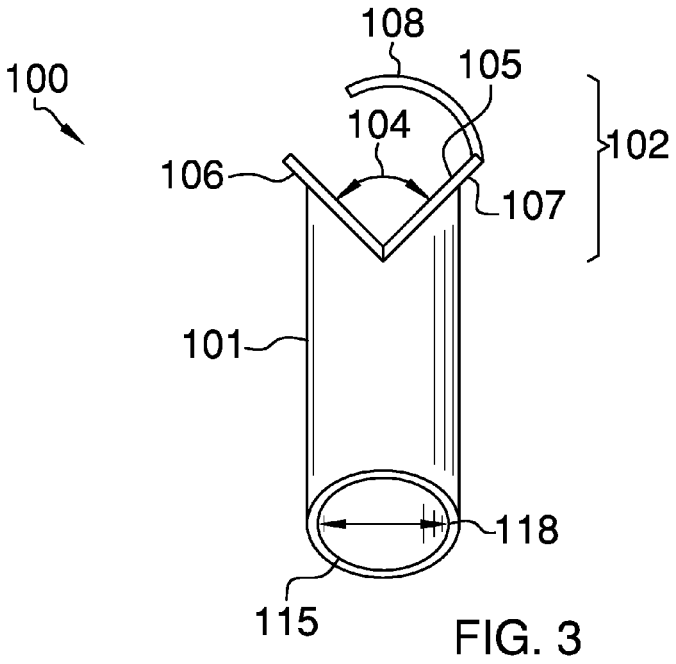
FIG. 3 is a front view of an embodiment of the disclosure.
Figure 4:
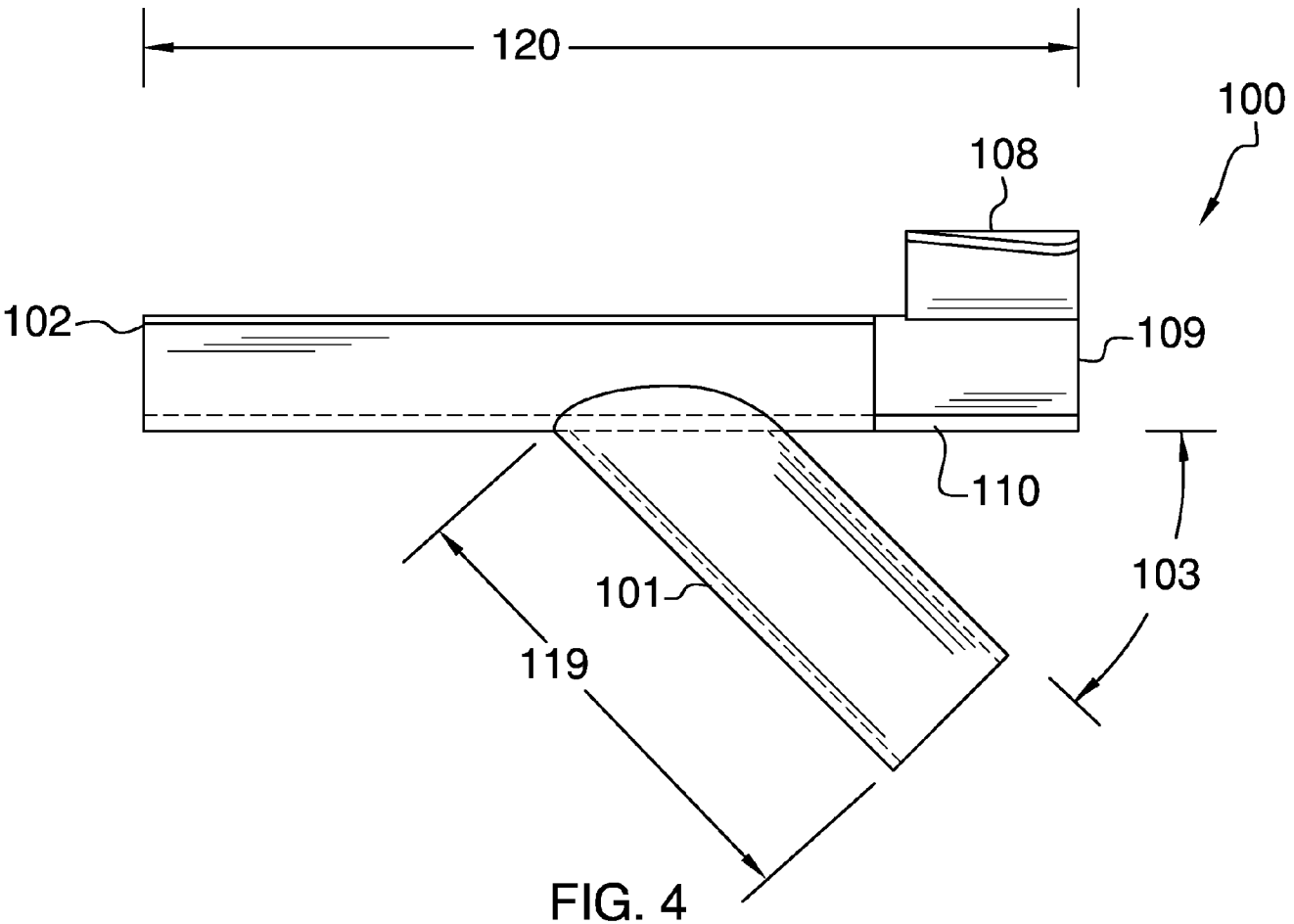
FIG. 4 is another side view of an embodiment of the disclosure.
Figure 5:
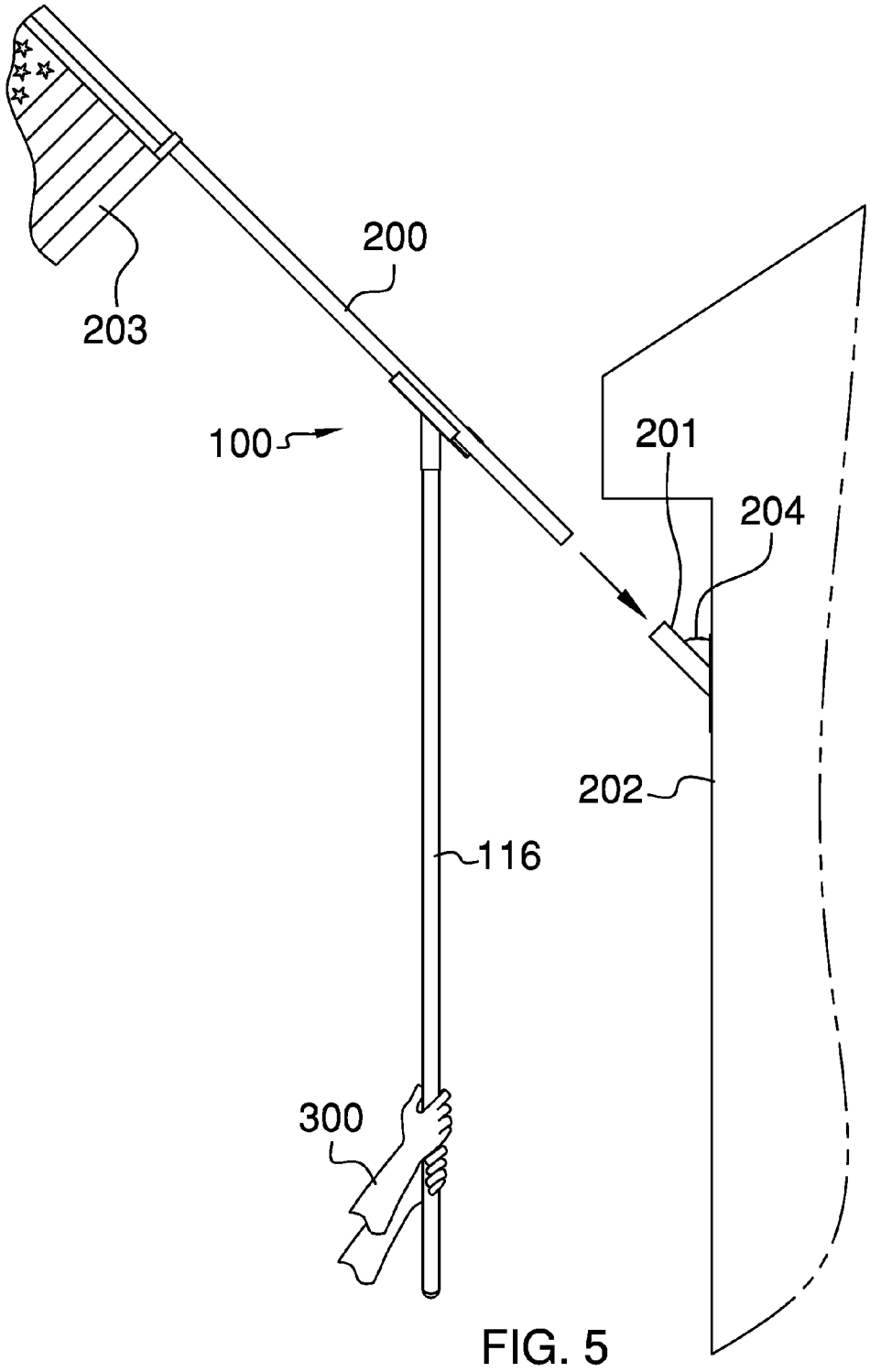
FIG. 5 is view of an embodiment of the disclosure in use.

Detailed reference will now be made to a first potential embodiment of the disclosure, which is illustrated in FIGS. 1 through 5.

The flag-maneuvering tool 100 (hereinafter invention) comprises a handle tube 101 that is rigidly affixed to a flagpole member 102. An acute angle 103 is formed between the handle tube 101 and the flagpole member 102. The acute angle 103 is ideally 45 degrees, but may vary depending on the particular application of the invention 100.

The flagpole member 102 may be constructed of a piece of angle iron, and which is open from above. The flagpole member 102 is further defined with a right angle 104 provided on an inner surface 105 amongst a first portion 106 and a second portion 107. Both the first portion 106 and the second portion 107 collectively form the flagpole member 102. The first portion 106 is a mirror of the second portion 107.

The second portion 107 includes a holding sleeve 108 at a first distal end 109 of the flagpole member 102. The holding sleeve 108 is a curved member that extends over a portion of the flagpole member 102. In Referring to FIG. 2, the holding sleeve 108 has a triangular shape when viewed from above, which enables a flagpole 200 to be inserted against the inner surface 105 of the flagpole member 102. Since, the holding sleeve 108 does not extend or span across to the first portion 106, the flagpole member 102 is adapted to be secured to and disassociated from the flagpole 200 as needed. That being said, the invention 100 is a device that is in use only temporarily.

The overall function of the invention 100 is to aid in manipulation of the flagpole 200. More specifically, the invention 100 aids in removal or installation of the flagpole 200 with respect to a flagpole bracket 201. Referring to FIG.

5, the flagpole bracket 201 is typically mounted against a stationary surface 202 such as a side of a building. Moreover, the flagpole bracket 201 is commonly screwed or bolted to the stationary surface 202 at a height or elevation that is usually hard to reach or simply out of reach of an end user 300. The invention 100 is adapted to engage the flagpole 200 just below a flag 203. Moreover, the acute angle 103 formed between the handle tube 101 and the flagpole member 102 enhances the ability to manipulate the flagpole 200 because the flagpole bracket 201 usually forms a second acute angle 204 between the flagpole bracket 201 and the stationary surface 202.

The first portion 106 of the flagpole member 102 also includes a notch 110 at the first distal end 109. The notch 110 works in concert with the holding sleeve 108 to adaptively engage and disengage the flagpole 200 with respect to the invention 100.

The handle tube 101 is further defined with a tube end 115 that enables a pole 116 to be inserted and secured to the handle tube 101. The end user 300 grasps the pole 116 in order to operate the invention 100. Moreover, the pole 116 enables the end user 300 to manipulate the flagpole member 102 in order to install or disengage the flagpole 200 with respect to the flagpole bracket 201. It shall be noted that the pole 116 is of an undefined length, and includes a pole outer diameter 117 that corresponds with an inner diameter 118 of the tube end 115 of the handle tube 101.

The handle tube 101 has a tube length 119 that is usually less than a member length 120 of the flagpole member 102. The member length 120 may be not less than 4 inches; whereas the tube length 119 is not more than 4 inches.

The pole 116 may be made of a same material as the rest of the componentry of the invention 100. Moreover, the flagpole member 102 and the handle tube 101 may be made of a single piece construction or two individual components that are rigidly affixed to one another. The flagpole member 102 and the handle tube 101 may be made of a material comprising a plastic, metal, wood, or carbon fiber composite. The pole 116 is ideally made of a metal or a wood.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A flag-maneuvering tool comprising:

a handle tube acutely oriented with respect to a flagpole member;

wherein the handle tube enables a pole to be secured thereto;

wherein the flagpole member is adapted to be selectively secured to a flagpole such that the flag-maneuvering tool is able to manipulate said flagpole from a hard to reach locale in order for said flagpole to be inserted or removed from a flagpole bracket that is attached to a stationary surface;

wherein an acute angle is formed between the handle tube and the flagpole member;

wherein the flagpole member is constructed of an angle iron;

wherein the flagpole member is further defined with a right angle provided on an inner surface amongst a first portion and a second portion;

wherein the first portion is a mirror of the second portion;

wherein the second portion includes a holding sleeve at a first distal end of the flagpole member.

2. The flag-maneuvering tool according to claim 1 wherein the holding sleeve is a curved member that extends over a portion of the flagpole member.

3. The flag-maneuvering tool according to claim 2 wherein the holding sleeve has a triangular shape when viewed from above, which is adapted to enable the flagpole to be inserted against the inner surface of the flagpole member.

4. The flag-maneuvering tool according to claim 3 wherein the acute angle formed between the handle tube and the flagpole member enhances the ability to manipulate the flagpole since the flagpole bracket forms a second acute angle between the flagpole bracket and the stationary surface.

5. The flag-maneuvering tool according to claim 4 wherein the first portion of the flagpole member is further defined with a notch at the first distal end.

6. The flag-maneuvering tool according to claim 5 wherein the notch works in concert with the holding sleeve to adaptively engage and disengage the flagpole with respect to the flagpole member.

7. The flag-maneuvering tool according to claim 6 wherein the handle tube is further defined with a tube end that enables the pole to be inserted and secured to the handle tube; wherein the end user grasps the pole in order to operate the flag-maneuvering tool.

8. The flag-maneuvering tool according to claim 7 wherein the pole enables the end user to manipulate the flagpole member in order to install or disengage the flagpole with respect to the flagpole bracket; wherein the pole is of an undefined length, and includes a pole outer diameter that corresponds with an inner diameter of the tube end of the handle tube.

9. The flag-maneuvering tool according to claim 8 wherein the handle tube has a tube length that is less than a member length of the flagpole member.

10. The flag-maneuvering tool according to claim 9 wherein the flagpole member and the handle tube are made of a material comprising a plastic, metal, wood, or carbon fiber composite.

* * * * *